US007516957B2

(12) United States Patent
Hamaya et al.

(10) Patent No.: US 7,516,957 B2
(45) Date of Patent: Apr. 14, 2009

(54) IMAGE FORMING APPARATUS

(75) Inventors: Satoshi Hamaya, Hachioji (JP); Tetsu Sekine, Sagamihara (JP); Hideo Isohara, Hachioji (JP); Yujiro Ishida, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 449 days.

(21) Appl. No.: 11/413,338

(22) Filed: Apr. 28, 2006

(65) Prior Publication Data

US 2007/0001387 A1 Jan. 4, 2007

(30) Foreign Application Priority Data

Jun. 10, 2005 (JP) ..... 2005-170588
Jun. 16, 2005 (JP) ..... 2005-176210

(51) Int. Cl.
*B65H 7/02* (2006.01)

(52) U.S. Cl. ..... 271/227; 271/228

(58) Field of Classification Search ..... 271/227, 271/228

See application file for complete search history.

(56) References Cited

U.S. PATENT DOCUMENTS 5,795,087 A * 8/1998 Brower et al. ..... 400/636
6,155,561 A * 12/2000 Mandel ..... 271/254
6,581,929 B2 * 6/2003 Hiramitsu ..... 271/228
7,195,238 B2 * 3/2007 Suga et al. ..... 271/228

FOREIGN PATENT DOCUMENTS

EP 58134780 8/1983
EP 59114083 6/1984

* cited by examiner

*Primary Examiner*—David H Bollinger
(74) *Attorney, Agent, or Firm*—Lucas & Mercanti, LLP

(57) ABSTRACT

An image forming apparatus provided with a bent sheet feeding guide member in the transportation path for transporting the recording material with the inclination along the width direction of the guide surface configured by the bent sheet feeding guide member being variable, or provided with a pair of transporting rollers that transports a recording material in the transportation path for transporting a recording material with the inclination of the pair of transporting rollers along the axial direction being variable with respect to the transportation surface.

11 Claims, 5 Drawing Sheets

IMAGE FORMING APPARATUS

This application is based on Japanese Patent Application No. 2005-170588 filed on Jun. 10, 2005 and No. 2005-176210 filed on Jun. 16, 2005 in Japanese Patent Office, the entire content of which is hereby incorporated by reference.

BACKGROUND OF THE INVENTION

The present invention relates to image forming apparatuses having an inclination adjustment device that corrects skewed movement along the transportation direction (hereinafter referred to also as sheet skew) of the recording material that is conveyed along the transportation path.

Conventionally, the adjustment of transportation position of transfer material as a recording material is carried out by adjusting the position of the transporting roller by a transporting roller inclination adjustment device and a position adjustment device after detecting the skewed movement along the transportation direction and deviation to one side of the transfer material.

As an example of position adjustment, a method of correcting shift in the position has been proposed (see, for example, Patent Document 1) in which an inclination detection device and a position detection device that detect the inclination or the position are provided on the downstream side of a pair of transporting rollers with respect to the perpendicular direction of transportation direction of the transfer material, and the inclination and position of the transfer material in the state in which it is gripped by this pair of transporting rollers are detected by said detection device, and then the shift in the position of the transfer material is corrected based on the result of that detection.

However, in the above method, it is necessary to return the transporting rollers to the base position for each transfer material, and has a disadvantage of decreasing the production efficiency.

Patent Document 1: non-examined Japanese Patent Publication No. 10-67448

SUMMARY

Embodiments of the present invention include the following image forming apparatuses.

(1) An image forming apparatus provided with a bent sheet feeding guide member in a transportation path for transporting a recording material, and having the feature that it is possible to adjust the inclination along the width direction of the guide surfaces constituted by the bent sheet feeding guide member.

(2) An image forming apparatus provided with a bent sheet feeding guide member in a transportation path for transporting a recording material, and having the feature that it has been configured so that the path length on one end side and the path length on the other end side along the width direction of the transportation path can be adjusted.

(3) An image forming apparatus provided with a pair of transporting rollers that transports a recording material to a transportation path for transporting a recording material, and having the feature that the inclination of the axis of the pair of transporting rollers with respect to the transportation surface can be varied.

(4) An image forming apparatus provided with a pair of transporting rollers that transports a recording material to a transportation path for transporting a recording material, and having the feature that the configuration is such that the balance of the pressing force of one of the pair of transporting rollers on the other can be adjusted in the axial direction.

DETAILED DESCRIPTION OF THE PREFERRED EMBODIMENT

The First Preferred Embodiment

An image forming apparatus having a sheet feeding guide member that can correct sheet skew according to the present invention is described in the following.

In the explanation of the preferred embodiments of the present invention, the terminology used in this specification shall not be construed to restrict in any manner the technical scope of the present invention.

Figure 1:
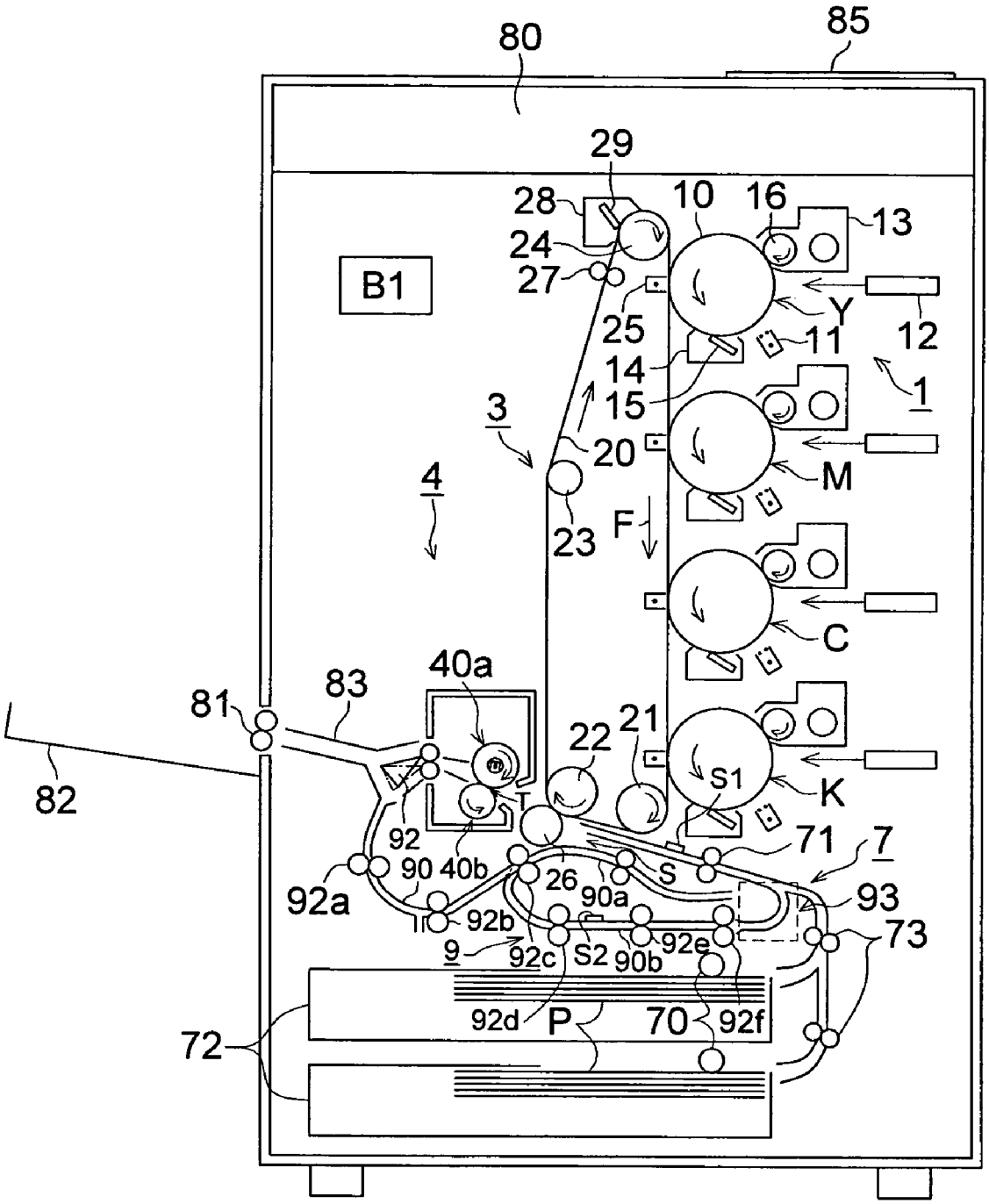
FIG. 1 is a schematic diagram showing an example of the overall configuration of an image forming apparatus.

FIG. 1 is a schematic diagram showing an example of the overall configuration of an image forming apparatus.

In FIG. 1, the numerical symbol 10 denotes a photoreceptor, 11 denotes a scorotron charger that constitutes the charging device, 12 denotes a writing unit that is an image writing device, 13 denotes a development unit, 14 denotes a cleaning unit that cleans the surface of the photoreceptor 10, 15 denotes a cleaning blade, 16 denotes a development sleeve, and 20 denotes an intermediate image transfer belt. The image forming unit 1 is configured to have the photoreceptor 10, the scorotron charger 11, the developing unit 13, and the cleaning unit 14, etc., and since the mechanical configuration of the image forming units 1 of each of the colors is almost identical, the reference numbers have been assigned only for the yellow (Y) system in FIG. 1, and the reference numbers have been omitted for the magenta (M), cyan (C), and black (K) system constituent elements.

The placement of the image forming units 1 for each color is in the sequence of Y, M, C, and K along the direction of transportation of the intermediate image transfer belt 20, each photoreceptor 10 is in contact with the stretched surface of the intermediate image transfer belt 20, and rotates in the same direction and at the same speed at the point of contact.

The intermediate transfer belt 20 is stretched over a driving roller 21, a grounding roller 22, a tension roller 23, a discharging roller 27, and a follower roller 24, and a belt unit 3 is configured by all these rollers and the intermediate image transfer belt 20, a transfer unit 25, and a cleaning unit 28, etc.

The drive of the intermediate image transfer belt 20 is carried out by the rotation of the driving roller 21 which is driven by a drive motor not shown in the figure.

The photoreceptor 10 is a cylindrical metal base material formed, for example, of an aluminum based material whose outer periphery is coated with a photosensitive layer such as a-Si or an organic photoreceptor (OPC), and is rotated in the counter-clockwise direction as indicated by the arrow in FIG. 1 in the state in which the conductive layer is grounded.

The electrical signal corresponding to the image data from the reading unit 80 is converted into an optical signal by the image forming laser, and this light is projected onto the photoreceptor 10 by the writing unit 12.

The developing unit 13 has a cylindrical shaped developing sleeve 16 formed of non-magnetic stainless steel or of an aluminum based material that rotates in a direction opposite to the direction of rotation of the photoreceptor 10 so that it maintains a prescribed spacing from the peripheral surface of the photoreceptor 10 and moves in the same direction at the closest position.

The intermediate image transfer belt 20 is an endless belt with a volume resistivity of $10^6$ to $10^{12}$ Ω-cm, and is a semi-conductive seamless belt with a thickness of 0.04 to 0.10 mm and made of an engineering plastic such as modified polyimide, thermosetting polyimide, ethylene tetrafluoroethylene copolymer, polyfluorovinylidene, or nylon alloy in which a conductive material has been dispersed.

The numeric symbol 25 indicates the transfer unit to which a DC voltage opposite in polarity to that of the toner has been applied, and which has the function of transferring the toner image formed on the photoreceptor 10 onto the surface of the intermediate image transfer belt 20. Apart from a corona discharging unit, it is also possible to use a transfer roller as the transfer unit 25.

The numeric symbol 26 indicates a transfer roller that can be contacted with or removed away from the grounding roller 22, and transfers again the toner image formed on the intermediate image transfer roller 20 onto the transfer material P which is a recording material.

The numeric symbol 28 indicates a cleaning unit which is provided opposite to the driven roller 24 with the intermediate image transfer belt 20 in between them. After the toner image has been transferred onto the transfer material P, the electric charge on the residual toner remaining on the intermediate image transfer belt 20 is weakened by the discharging roller 27 to which an AC voltage superimposed with a DC voltage of the same or opposite polarity as the charge on the toner has been applied, and the toner remaining on the outer surface of the intermediate image transfer belt 20 is cleaned by the cleaning blade 29. The numeric symbol 4 indicates a fixing unit which is constituted using a heating roller 40*a* with an internal halogen heater and a pressure roller 40*b*.

The numeric symbol 7 indicates the sheet feeding transportation path that is the first sheet transportation path for single-sided image formation, 70 is a sheet feeding roller, 71 is timing rollers; 72 is sheet feeding cassettes, and 73 is transporting rollers.

The numeric symbol 81 indicates sheet discharging rollers, 82 is a sheet discharge tray, and 85 is an operation panel.

The numeric symbol 9 indicates an ADU mechanism section that includes a transportation path that becomes the second sheet transportation path of the transfer material at the time of double-sided image formation. Here, B1 is a control section that controls respective different driving sections, the image forming process, the fixing temperature, and the adjustment of the sheet feeding guide member to be described later and the like.

The image forming process is described below based on FIG. 1.

When image recording is started, the drive motor, not shown in the figure, of the photoreceptor drum starts rotating, which in turn rotates the photoreceptor 10 of the yellow (Y) color image forming unit 1 in the direction of the arrow shown in the figure, and at the same time, the potential of the photoreceptor 10 starts to be built up due to the charging operation of the scorotron charger unit 11.

After the photoreceptor 10 is charged to the prescribed potential, image writing is started by the writing unit 12 based on the electrical signal corresponding to the image data of the first color signal Y, thereby forming an electrostatic latent image on the surface of the photoreceptor 10 corresponding to the image of Y of the original document image.

The aforementioned electrostatic latent image is reversely developed in a non-contacting state by the developing unit 13, and a yellow (Y) toner image is formed according to the rotation of the photoreceptor 10.

The yellow (Y) toner image formed on the photoreceptor 10 which is the image forming body according to the above-mentioned image forming process is transferred onto the intermediate image transfer belt 20 by the transfer unit 25.

Next, the intermediate image transfer belt 20 is synchronized with the Y toner image, and in the magenta (M) image forming unit 1, after an electric potential is applied to the photoreceptor 10 due to the charging action by the scorotron charger 11, the image writing is carried out by the writing unit 12 based on the electrical signal corresponding to the color signal of M, that is, the image data of M. Toner image of M which has been formed on the surface of the photoreceptor 10 by reversely developing the electrostatic latent image in a non-contacting state by the developing unit 13, is transferred by the transfer unit 25 of M on the top of said Y toner image in a superimposing manner.

In a similar process, synchronization is performed with the superimposed toner images of Y and M, and in the cyan (C) image forming unit 1, the cyan C toner image corresponding to the C image data of the color signal of C, which has been formed on the surface of the photoreceptor 10 is transferred by the transfer unit 25 of C on the top of said Y and M toner images in a superimposing manner. Further, synchronization is performed with the superimposed toner images of Y, M, and C, and in the black (K) image forming unit 1, the black K toner image corresponding to the K image data of the black signal K, which has been formed on the surface of the photoreceptor 10 is transferred by the transfer unit 25 of K on the top of said Y, M, and C toner images in a superimposing manner and a superimposed color toner image of Y, M, C and K is formed on the intermediate image transfer belt 20.

In addition, the toner remaining on the photoreceptors 10 of each color after primary transfer is removed by the cleaning unit 14, and before charging, the history of the previous image forming on the photoreceptor 10 is erased by a uniform exposure unit not shown in the figure, and then the unit starts the next image forming cycle.

The intermediate image transfer belt 20 carrying said superimposed toner images is transported in the direction of the arrow F, the transfer material P is fed by the feeding roller 70 from the sheet feeding cassette 72 which is the transfer material storing unit, conveyed by the transporting roller 73 to the timing rollers 71 provided in the first sheet transportation path, synchronized with the toner image on the intermediate image transfer belt 20, and is fed to the transfer area S of the transfer roller 26 due to the drive of the timing rollers 71.

The image is transferred onto the transfer material P placed over the intermediate image transfer belt 20 in the transfer area S by being gripped between the grounding roller 22 and the transfer roller 26. In the fixing unit 4, the transfer material P carrying the toner image is gripped between a heated roller 40*a* and a pressure roller 40*b* and the image is fixed on it by applying pressure and heat.

Figure 3:
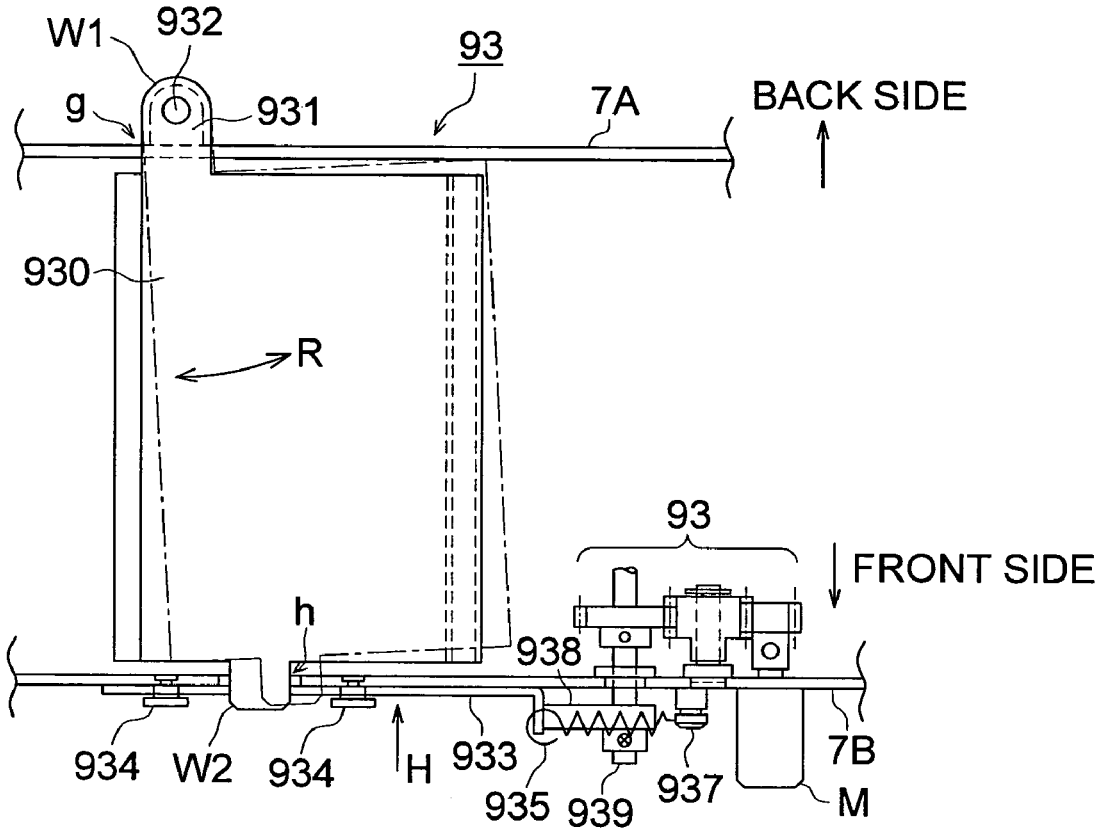
FIG. 3(*a*) and FIG. 3(*b*) are diagrams showing enlarged views of the sheet feeding guide member of FIG. 1.
Figure 3:
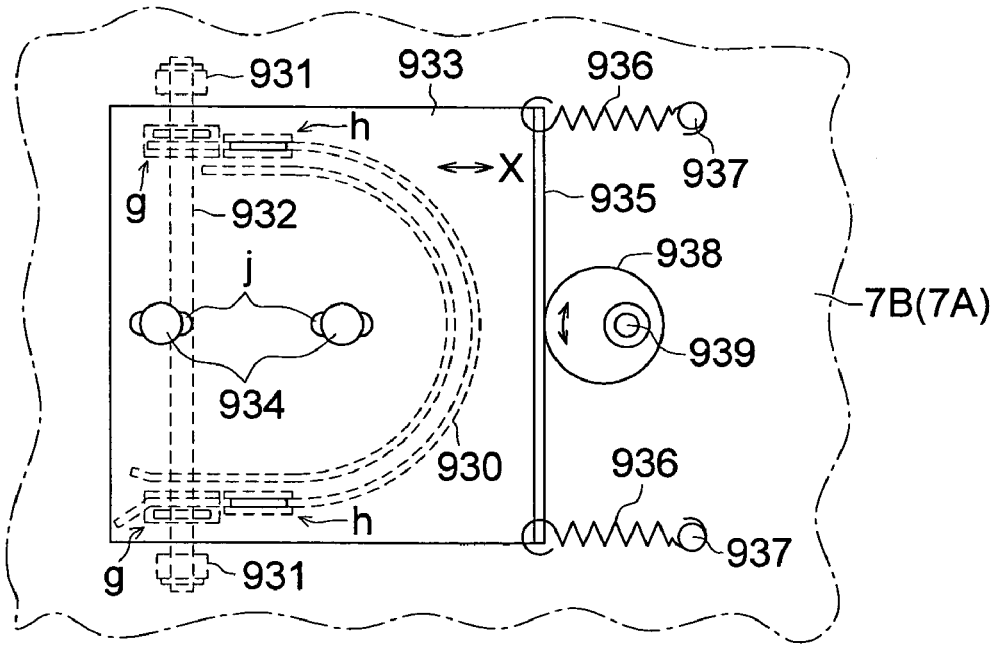

In the case of single-sided image formation, the transfer material P is conveyed to the sheet discharge guide 83 by the transportation path selection member 92 which is in the state indicated by a dot-and-dash line in FIG. 1, and is discharged to the sheet discharge tray 82 by the sheet discharge roller 81. Further, in the case of double-sided printing, the transfer material P, after fixing, is lowered by the transportation path selection member 92 which is in the state indicated by a continuous line in FIG. 1, is conveyed to the bent transportation path 90 by the transporting rollers 92*a*, enters the ADU mechanism section 9, and is conveyed to the sheet inversion path 90*a* by the transporting rollers 92*b* and 92*c*. In the sheet inversion path 90*a*, after stopping temporarily with the rear edge of the transfer material P being gripped, the transporting roller 92*c* starts rotating in the opposite direction, with the rear edge of the transfer material P being the front edge, and the transfer material P gets inverted by a transportation path selection member not shown in the figure, and proceeds to the transporting roller 92*d* and the transportation path 90*b*. Further, it is conveyed by the transporting rollers 92*e* and 92*f* to the sheet feeding guide member 93 that can adjust skewed transportation as shown in FIG. 3(*a*) and FIG. 3(*b*). The sheet skew (amount), which is the amount by which it has got skewed, is corrected in a direction at right angles to the direction of transportation and the transfer material P arrives at the timing rollers 71. Thereafter, synchronization is performed with the toner image on the intermediate image transfer belt 20, and due to the drive of the timing rollers 71, the transfer material P enters the first sheet transportation path as it is, fed to the transfer area S at the transfer roller 26, and thereafter subjected to the same process as during single-sided printing and is finally discharged.

Here, the sheet feeding guide member provided with the sheet skew adjustment mechanism which is an inclination adjusting device according to the present invention is described below.

In FIG. 1, the sheet feeding guide member 93 that forms the bent transportation path has been provided on the upstream side of the timing rollers 71.

Although sheet skew is particularly likely to occur in bent transportation paths, in the present preferred embodiment, the detection sensors S1 and S2 that detect skewing of the sheet have been provided in the straight transporting section of the sheet transportation path. The detection sensors S1 and S2 are area sensor devices made of CCDs, and have been provided in the transportation path. The detection of the amount of skewing of the transfer material with respect to the transportation direction is made from the detection value detected by the detection sensor S1 and the detection value detected by the detection sensor S2, the detected position signal is sent to the control section B1, and the amount of sheet skew is calculated from the difference of the two detected values. This amount of sheet skew is corrected by the sheet feeding guide member provided with an inclination adjustment device as shown in FIG. 3(*a*) and FIG. 3(*b*).

Figure 2:
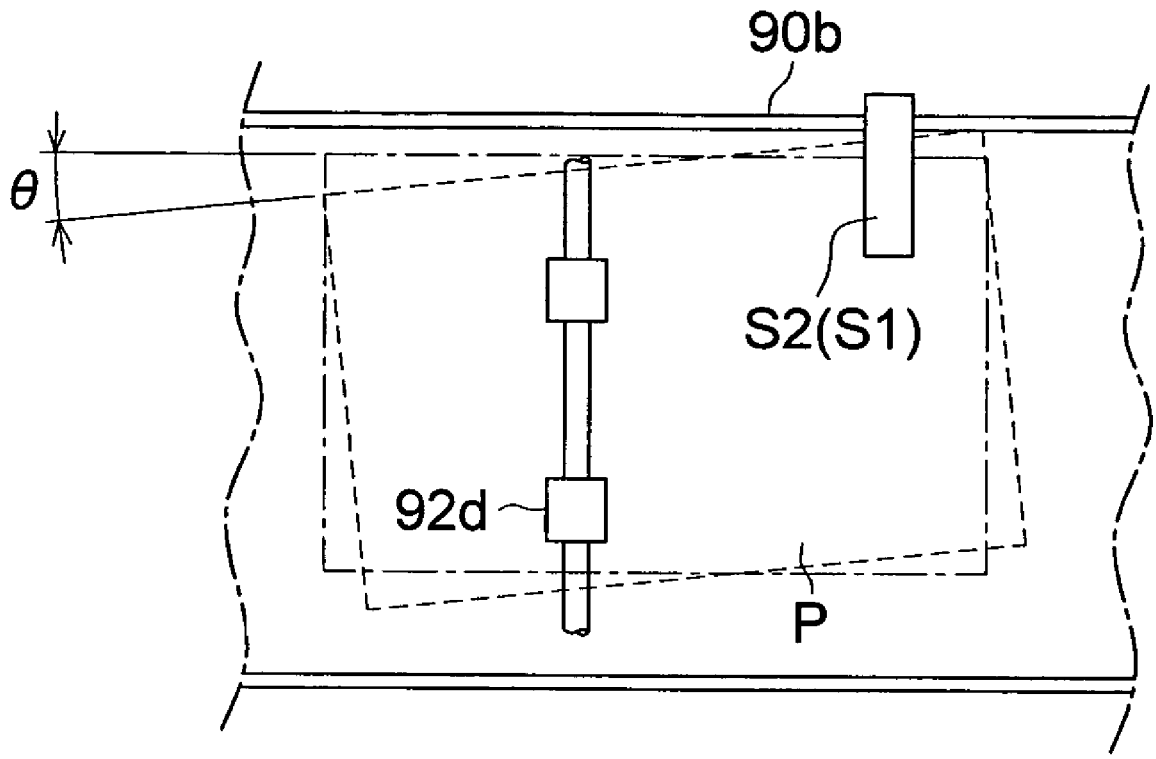
FIG. 2 is a diagram showing the transfer material P in the straight transporting section and a detection sensor that detects the position of passage of the edge part of the transfer material P.

FIG. 2 is a diagram showing the transfer material P in the straight transporting section and the detection sensor that detects the position of passage of the edge part of the transfer material P.

In FIG. 2, the transfer material P indicated by the dot-and-dash lines is detected by the tilt detection sensor S1 (see FIG. 1) and the skewed state indicated by the dotted lines is detected at the time of passing the detection sensor S2, and it is possible to calculate the amount of skew θ from the detected values. In other words, this amount of skew θ, during double-sided image formation, indicates the amount of skew caused after the transfer material P has passed over the tilt detection sensor S1 until it reaches the tilt detection sensor S2 after passing through the bent section of the ADU mechanism section 9.

FIG. 3(*a*) and FIG. 3(*b*) are diagrams showing enlarged views of the sheet feeding guide member of FIG. 1.

FIG. 3(*a*) is a diagram as viewed from above the sheet feeding guide member 93 and FIG. 3(*b*) is the diagram as viewed from the direction of the arrow H in FIG. 3(*a*).

In FIG. 3(*a*) and FIG. 3(*b*), symbols 7A and 7B indicate the frame members of the main body of the sheet feeding unit. The numeric symbol 930 is the bent guide plate that forms the bent transportation path, and the top and bottom parts W1 at the back side of this bent guide plate pass through and project beyond the opening part "g" in the frame member 7A, and are supported by the pivot shaft 932 which is supported by the supporting block 931 fixed to said frame member 7A. On the other hand, the top and bottom parts W2 at the front side pass through and project beyond the opening part h in the frame member 7B, and have been inserted in the prescribed locations of the slide plate 933. This slide plate 933 slides in the direction of the arrow X along the guide pin 934 riveted to the frame member 7B via the guiding groove "j". In addition, the slide plate 933 has a folded part 935, and this folded part 935 are attached to the hooks on one end of the top and bottom springs 936, and the hooks on the other ends of these springs are engaged with the stopper pins 937 riveted to the frame member 7B, and at approximately the middle position of said folded part 935, the slide plate 933 these is pushed against an eccentric cam 938 by the force of these springs. This eccentric cam 938 has been mounted integrally with the rotary shaft 939 supported by the frame members 7A and 7B via bearings and rotates by a specific angle upon being driven by the stepping motor M via a sequence of gear wheels 93.

The bent guide plate 930 can swing in the direction of the arrow R with the pivot shaft 932 as the pivotal point due to the reciprocating movement of said slide plate 933, and can adjust the skew of the sheet by changing the length of the transportation paths at the front and rear sides of the transported transfer material P. In addition, although the amount of sideward shift of the transfer material remains even after its skew has been corrected, it is possible to maintain the base image position by changing the writing position of the writing unit 12 (the writing timing in the main scanning direction) under the instruction from the control section B1.

The position information detected by the tilt detection sensors S1 and S2 is transmitted to the control section B1. The control section B1 calculates the difference between the detected values (sheet skew amount) based on the position information obtained from the two sensors S1 and S2. Next, the control section B1 controls the drive of the stepping motor M in accordance with the amount of change in the length of the transportation path equivalent to the calculated value so that the subsequent transfer material P is not skewed in the same manner. Because of the drive of the stepping motor M, the eccentric cam 938 rotates by a prescribed angle, and the bent guide plate 930 gets displaced via the slide plate 933. Because of this, at the time of double-sided image formation, the inclination of the transfer material at the time of forming the images on the first surface and the inclination of the transfer material at the time of forming the images on its second surface can be made identical, and hence it is possible to prevent the generation of inclination between the images of the first surface and the images of the second surface. In the field of light printing, extremely high quality output images equivalent to offset printing are demanded, and also the demanded accuracy is also extremely high for the inclination of the images on the second surface with respect to the images on the first surface in double-sided image formation. According to the image forming apparatus of the present invention, it is possible to suppress the inclination of the images on the second surface with respect to the images on the first surface with a high accuracy.

Furthermore, after detecting the transfer material by the tilt detection sensor S2, the same transfer material is detected by the tilt detection sensor S1 when it reaches the detection sensor S1 again, the difference between the detected value by the detection sensor S2 and the detected value by the detection sensor S1 is calculated by the control section B1, and according to this value, the bent guide plate 930 is deflected further. Because of this, since it is possible to prevent skewing of the transfer material that occurs during the bend of the sheet feeding guide plate 93 after it has passed over the tilt detection sensor S2, it is possible to further suppress the inclination of the images on the second surface with respect to the images on the first surface with a high accuracy.

Further, a program related to the amount of variation of the length of the transportation path according to the amount of sheet skew has been stored in the control section B1. The control section B1, based on this program, controls the drive of the stepping motor M in order to displace the bent guide plate. In addition, even regarding the timing of starting writing according to the sideways shift of the transfer material P along the main scanning direction, a program has been stored in the control section B1.

Further, in the present preferred embodiment, although explanation was given of an example of applying the present invention to correcting sheet skew at the time of image formation on the back surface during double-sided image formation, it can also be applied to the bent sheet feeding guide section in the first sheet transportation path, and also, it is possible to apply the present invention to an image forming apparatus that carries out only single-sided image formation but is provided with a bent sheet feeding guide plate in the transportation path. When applied to such apparatuses, it is sufficient to have a configuration in which the tilt detection sensor is placed only on the downstream side of the bent section along the transportation path, the amount of sheet skew is detected by the tilt detection sensor after the transfer material has passed through the bent section, and the bent sheet guide plate is swung based on the result of that detection.

In addition, as has been shown in the present preferred embodiment, although it is desirable to have a configuration of adjusting the inclination along the width direction of the sheet feeding guide member automatically by the control section B1, it is not necessary to restrict to this, but it is possible also to have a configuration in which manual adjustment is made after checking the inclination of the images on the transfer material that has been outputted.

In addition, it is not necessary to restrict the present invention to electro-photographic method image forming apparatuses, but also the present invention can be applied to ink jet or other types of image forming apparatuses.

The Second Preferred Embodiment

In the second preferred embodiment of the present invention, a case is explained in which the present invention is applied to an image forming apparatus having a pair of transporting rollers that can adjust sheet skew. However, in order to simplify the explanations, same symbols have been assigned to parts that are identical with the first preferred embodiment described above, and their detailed explanations will be omitted suitably.

Figure 4:
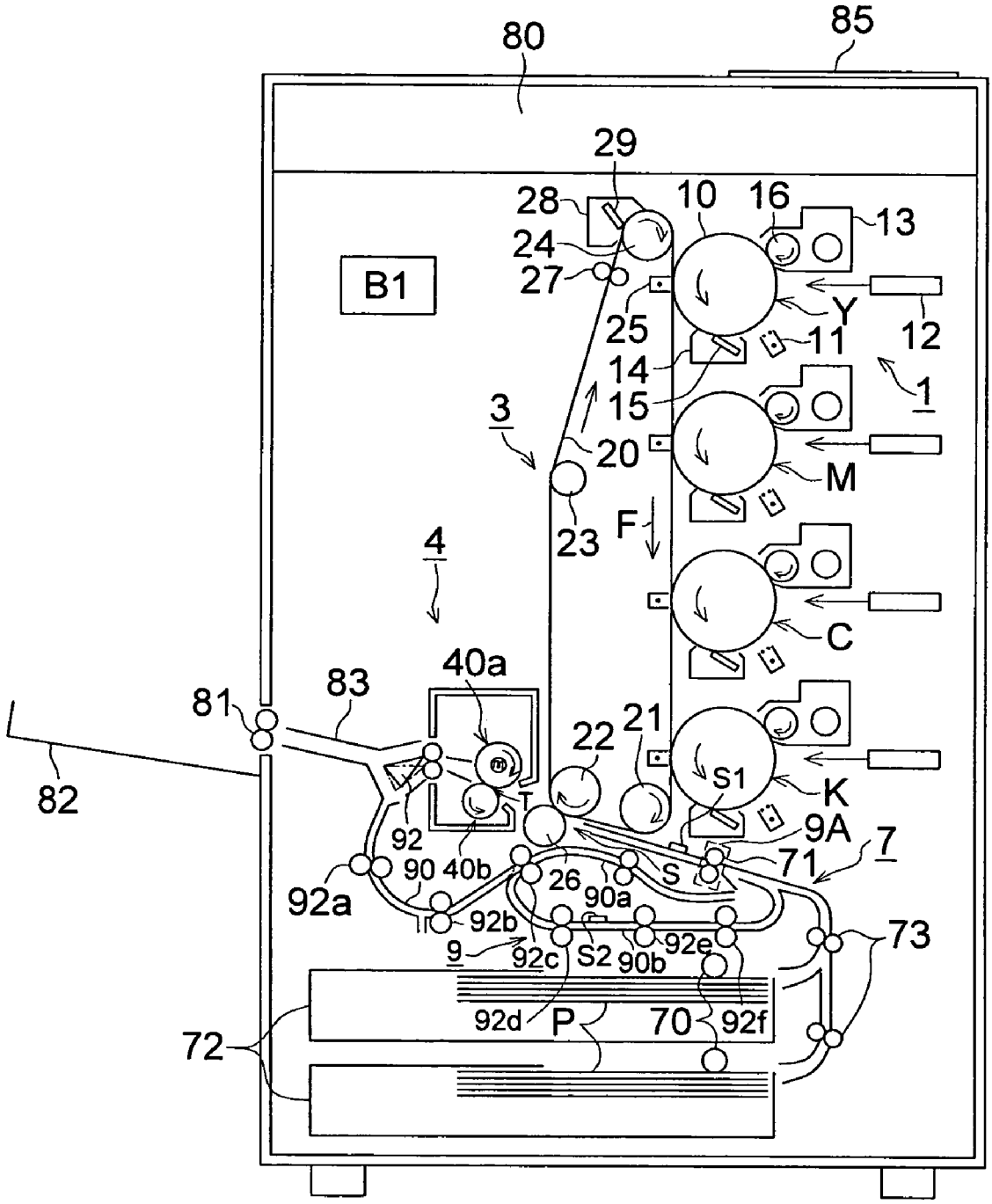
FIG. 4 is a schematic diagram showing an example of the overall configuration of an image forming apparatus.
Figure 5:
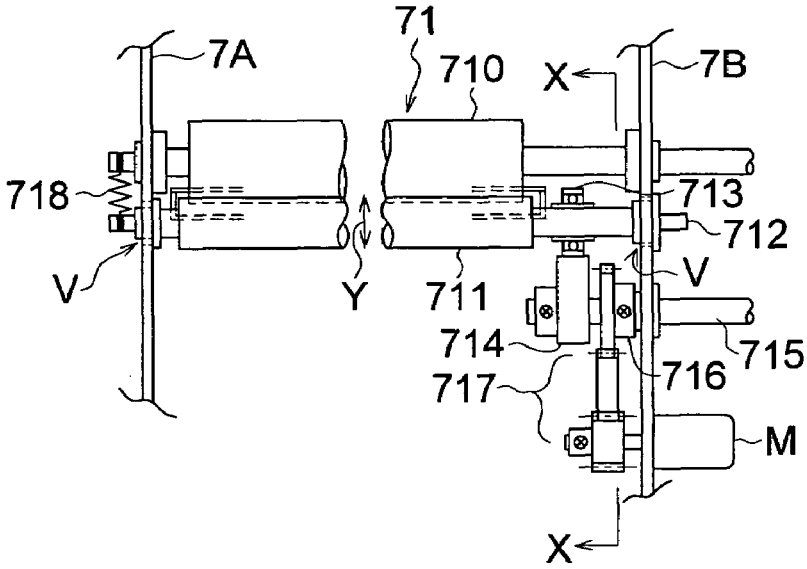
FIG. 5(*a*) and FIG. 5(*b*) are diagrams showing enlarged views of the pressure adjustment device applied to the timing rollers of FIG. 4.
Figure 5:
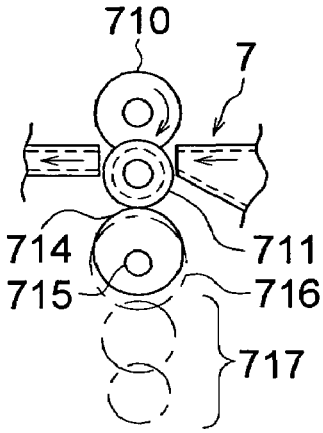

In the present preferred embodiment, the timing rollers 71 are timing rollers that are a pair of transporting rollers provided with a pressure adjustment device 9A (see FIG. 4, FIG. 5(*a*) and FIG. 5(*b*)), and is configured so that one of the rollers is the sheet feeding roller 710 and the other is a follower roller 711.

In the case of double-sided printing, similar to the first preferred embodiment, the transfer material P, after proceeding to the transporting roller 92*d* and the transportation path 90*b*, is further transported by the transporting rollers 92*e* and 92*f* to and stops temporarily at the timing rollers 71 which are a pair of transporting rollers having a pressure adjustment device 9A, synchronized with the toner image on the intermediate image transfer belt 20 and is ready for transfer. Thereafter, any skew in the sheet is corrected due to the drive of the timing rollers 71, fed to the transfer area S of the transfer roller 26, and thereafter subjected to the same process as in single-sided printing and is discharged.

Next, the pressure adjustment device 9A of the timing rollers 71 which are a pair of transporting rollers according to the present invention is described in the following.

In the present preferred embodiment, the pressure adjustment device of a pair of transporting rollers is applied to the timing rollers 71. Similar to the first preferred embodiment, the skew of the transfer material with respect to the direction of transportation is detected from the detected value detected by the tilt detection sensor S1 and the detected value detected by the tilt detection sensor S2, the detected position signal is sent to the control section B1, and the amount of sheet skew is calculated from the difference between the two detected values. This amount of sheet skew is corrected by the timing rollers provided with a pressure adjustment device as shown in FIG. 5(*a*) and FIG. 5(*b*).

In FIG. 2, the transfer material P indicated by the dot-and-dash lines is detected by the tilt detection sensor S1 (see FIG. 4) and the skewed state indicated by the dotted lines is detected at the time of passing the detection sensor S2, and it is possible to calculate the amount of skew θ from the detected values. In other words, this amount of skew θ, during double-sided image formation, indicates the amount of skew caused after the transfer material P has passed over the tilt detection sensor S1 until it reaches the tilt detection sensor S2 after passing through the bent section of the ADU mechanism section 9.

FIG. 5(*a*) and FIG. 5(*b*) are diagrams showing enlarged views of the pressure adjustment device applied to the timing rollers of FIG. 4.

FIG. 5(*a*) is a diagram as viewed from the transportation direction of the transfer material, and FIG. 5(*b*) shows the cross-section as viewed from the direction X in FIG. 5(*a*).

In FIG. 5(*a*), symbols 7A and 7B are the frames of the sheet feeding main unit. The timing rollers 71 have a rubber sheet feeding roller 710 supported via bearings fixed to the frame members 7A and 7B, and a rubber follower roller 711 supported via bearings that are engaged with the long holes V in the frame members 7A and 7B and slide in the direction of the arrow Y, and these two rollers are in a state of being pressed against each other by the pressing spring 718 at the end part of the roller shaft on the side of the frame member 7A, and said sheet feeding roller 710 rotates being driven from a driving section not shown in the figure. A bearing 713 has been affixed on the frame member 7B side of the rotating shaft 712 of said follower roller 711, and this bearing 713 is in contact with the eccentric cam 714 which has an integral structure with the cam rotating shaft 715. Further, a driving gear 716 has been provided to the cam rotating shaft 715 and rotates by receiving the driving force from the stepping motor M via a series of gears, and rotates said eccentric cam 714 by a prescribed angle. In other words, the balance of the pressing force along the axial direction of the follower roller 711 against the sheet feeding roller 710 can be adjusted by the angle of rotation of said eccentric cam 714, and hence it is possible to correct the skew of the transfer material gripped by these rollers.

Although the amount of sideward shift of the transfer material remains even after its skew has been corrected, it is possible to maintain the base image position by changing the writing position of the writing unit 12 (the writing timing in the main scanning direction) under the instruction from the control section B1.

The position information detected by the tilt detection sensors S1 and S2 is transmitted to the control section B1. The control section B1 calculates the difference between the detected values (the amount of sheet skew) based on the position information obtained from the two sensors S1 and S2. Next, the control section B1 controls the drive of the stepping motor M in accordance with the calculated value in order to change the pressing force between the sheet feeding roller 710 and the follower roller 711 so that the subsequent transfer material P is not skewed in the same manner. Because of the drive of the stepping motor M, the eccentric cam 714 rotates by a prescribed angle thereby changing the pressing force of the follower roller 711 onto the sheet feeding roller 710. Because of this, the balance of the pressing force along the axial direction of the follower roller 711 onto the sheet feeding roller 710 is changed, thereby suppressing the sheet skew at the time of transporting the next transfer material. Because of this, at the time of double-sided image formation, the inclination of the transfer material at the time of forming the images on the first surface and the inclination of the transfer material at the time of forming the images on its second surface can be made identical, and hence it is possible to prevent the generation of inclination between the images of the first surface and the images of the second surface. In the field of light printing, extremely high quality output images equivalent to offset printing are demanded, and also the demanded accuracy is also extremely high for the inclination of the images on the second surface with respect to the images on the first surface in double-sided image formation. According to the image forming apparatus of the present invention, it is possible to suppress the inclination of the images on the second surface with respect to the images on the first surface with a high accuracy.

Furthermore, after detecting the transfer material by the tilt detection sensor S2, the same transfer material is detected by the tilt detection sensor S1 when it reaches the detection sensor S1 again, the difference between the detected value by the detection sensor S2 and the detected value by the detection sensor S1 is calculated by the control section B1, and according to this value, the eccentric cam 714 is rotated, thereby further varying the pressing force of the follower roller 711 onto the sheet feeding roller 710. Because of this, since it is possible to prevent skewing of the transfer material that occurs during the bend of the sheet feeding guide plate 93 after it has passed over the tilt detection sensor S2, it is possible to further suppress the inclination of the images on the second surface with respect to the images on the first surface with a high accuracy.

Further, a program related to the amount of change in the pressing force of the rollers according to the amount of sheet skew has been stored in the control section B1. The control section B1, based on this program, controls the drive of the stepping motor M in order to change the pressing force of the rollers. In addition, even regarding the timing of starting writing according to the sideward shift of the transfer material P along the main scanning direction, a program has been stored in the control section B1.

Further, while in the present preferred embodiment, during double-sided image formation, a pressure adjustment device was applied to the timing rollers 71, this can also be applied to the transporting rollers 92*e* or 92*f*, for example, which is placed on the upstream side of the tilt detection sensor S1 and on the downstream side of the tilt detection sensor S2.

Further, in an image forming apparatus carrying out only single-sided image formation, it is possible to apply the pressure adjustment device according to the present invention before image transfer to the transfer material, thereby correcting sheet skew and adjusting the timing of starting to write on the image carrier.

In addition, it is not necessary to restrict the present invention to electro-photographic method image forming apparatuses, but also the present invention can be applied to ink jet or other types of image forming apparatuses.

According to the present invention, since it is possible to adjust the length of the transportation path on one edge side and the other edge side along the width direction in a bent transportation path, it is possible to avoid skew of the recording material.

In addition, stable transportation of the recording material without sheet skew became possible, and hence the accuracy of the image position relative to the recording material has been improved.

What is claimed is:

1. An image forming apparatus comprising:

a bent sheet feeding guide member in a transportation path for transporting a recording material, wherein an inclination in a width direction of a guide surface formed by the bent sheet feeding guide member is adjustable, and wherein the transportation path comprises:

a first sheet transportation path for single-sided image formation;

a second sheet transportation path for double-sided image formation, which is connected with the first sheet transportation path; and detection sensors positioned in the first sheet transportation path and the second sheet transportation path, the detection sensors detecting an inclination amount of the recording material with respect to a transportation direction of the recording material.

2. The image forming apparatus of claim 1, further comprising:

an inclination adjusting device for adjusting an inclination in a width direction of the guide surface formed by the bent sheet feeding guide member; and a controller for comparing detection values detected respectively by the detection sensors positioned in the sheet transportation paths, wherein the inclination adjusting device automatically adjusts the inclination in a width direction of the guide surface according to a signal from the controller based on a comparison result.

3. The image forming apparatus of claim 1, wherein the bent sheet feeding guide member is constituted with one end side of the member in a width direction being a supporting point such that another end side can swing around the supporting point.

4. An image forming apparatus comprising:

a bent sheet feeding guide member in a transportation path for transporting a recording material, wherein a path length on one end side and a path length on another end side in the width direction of the transportation path is variable, and wherein the transportation path comprises:

a first sheet transportation path for single-sided image formation;

a second sheet transportation path for double-sided image formation, which is connected with the first sheet transportation path; and detection sensors positioned in the first sheet transportation path and the second sheet transportation path, the detection sensors detecting an inclination amount of the recording material with respect to a transportation direction of the recording material.

5. The image forming apparatus of claim 4, wherein an inclination in a width direction of the guide surface formed by the bent sheet feeding guide member is adjustable and each of the path lengths can be varied by adjusting the inclination.

6. The image forming apparatus of claim 4, further comprising:

a path length adjusting device for adjusting the path length on one end side and the path length on another end side in the width direction of the transportation path formed by the bent sheet feeding guide member; and a controller for comparing detection values detected respectively by the detection sensors positioned in the sheet transportation paths, wherein the path length adjusting device automatically adjusts the path length on one end side and the path length on another end side in the width direction of the transportation path according to a signal from the controller based on a comparison result.

7. An image forming apparatus comprising:

a pair of transporting rollers which transports a recording material in a transportation path for transporting a recording material, wherein an inclination of the pair of transporting rollers in an axial direction can be varied with respect to a transportation plane, and wherein the transportation path comprises:

a first sheet transportation path for single-sided image formation;

a second sheet transportation path for double-sided image formation, which is connected with the first sheet transportation path; and detection sensors positioned in the first sheet transportation path. and the second sheet transportation path, the detection sensors detecting an inclination amount of the recording material with respect to a transportation direction of the recording material.

8. The image forming apparatus of claim 7, further comprising:

a pressure adjusting device for adjusting pressure of the pair of transporting rollers; and a controller for comparing detection values detected respectively by the detection sensors positioned in the sheet transportation paths, wherein the pressure adjusting device is controlled based on a signal from the controller.

9. The image forming apparatus of claim 7, wherein one of the pair of transporting rollers is supported slidably with respect to another of the pair of transporting rollers and one end side of the one of the pair of transporting rollers in an axial direction is urged to move toward the another of the pair of transporting rollers by an elastic member while another end side of the one of the pair of transporting rollers in an axial direction is movable by way of a pressure adjusting device.

10. An image forming apparatus comprising:

a pair of transporting rollers which transports a recording material in a transportation path for transporting a recording material, wherein a balance of pressing force of one of the pair of transporting rollers onto another of the pair of transporting rollers can be adjusted in an axial direction, and wherein the transportation path comprises:

a first sheet transportation path for single-sided image formation;

a second sheet transportation path for double-sided image formation, which is connected with the first sheet transportation path; and detection sensors positioned in the first sheet transportation path and the second sheet transportation path, the detection sensors detecting an inclination amount of the recording material with respect to a transportation direction of the recording material.

11. The image forming apparatus of claim 10, further comprising:

a pressure adjusting device for adjusting pressure of the pair of transporting rollers; and a controller for comparing detection values detected respectively by the detection sensors positioned in the sheet transportation paths, wherein the pressure adjusting device is controlled based on a signal from the controller.

* * * * *